US005202602A

United States Patent [19]

Ayers

[11] Patent Number: 5,202,602

[45] Date of Patent: Apr. 13, 1993

[54] METAL-GLASS COMPOSITE FIELD-EMITTING ARRAYS

[75] Inventor: Jack D. Ayers, Oakton, Va.

[73] Assignee: The United States of America as represented by the Secretary of the Navy, Washington, D.C.

[21] Appl. No.: 804,558

[22] Filed: Dec. 10, 1991

Related U.S. Application Data

[62] Division of Ser. No. 607,955, Nov. 1, 1990.

[51] Int. Cl.[5] ..... H01J 1/30; H01J 1/90

[52] U.S. Cl. ..... 313/309; 313/336; 313/351

[58] Field of Search ..... 313/309, 336, 351

[56] References Cited

U.S. PATENT DOCUMENTS

| | | | |
|---|---|---|---|
| 2,030,185 | 2/1936 | Rose | 49/73 |
| 3,259,782 | 7/1966 | Shroff | 313/336 |
| 3,840,955 | 10/1974 | Hagood et al. | 29/25.18 |
| 4,163,949 | 8/1979 | Shelton | 313/351 X |
| 4,498,952 | 2/1985 | Christensen | 156/643 |
| 4,756,928 | 7/1988 | Senda et al. | 427/77 |
| 4,874,981 | 10/1989 | Spindt | 313/309 |
| 4,969,850 | 11/1990 | Wales | 313/309 X |

FOREIGN PATENT DOCUMENTS

| | | | |
|---|---|---|---|
| 55-95257 | 7/1980 | Japan | 313/484 |

OTHER PUBLICATIONS

F. L. Carter ed., molecular electronic devices II, 1987, pp. 381–403.

*Primary Examiner*—Sandra L. O'Shea
*Attorney, Agent, or Firm*—Thomas E. McDonnell; Charles J. Stockstill

[57] ABSTRACT

A field-emitting array is provided which comprises at least one thin wafer having electrically conducting filaments extending through a glass matrix between a first and second parallel surface of the wafer. At the first surface, the filaments extend beyond the plane of the glass matrix. The filaments extending beyond the first surface have an electron-emitting coating on their cylindrical surfaces. The coating extends beyond the filament end to create a shape that emits electrons when an electrical field is applied between the filaments and an anode. In an alternative embodiment, the filaments are recessed below the first surface and a conducting coating forms an extractor on that surface.

8 Claims, 2 Drawing Sheets

METAL-GLASS COMPOSITE FIELD-EMITTING ARRAYS

This is a division of co-pending application Ser. No. 07/607,955 filed on Nov. 1, 1990.

BACKGROUND OF THE INVENTION

The present invention relates to field-emitting arrays and to a method of producing same and, more particularly, to an array of individual electron emitters which can be spaced at preselected distances from one another in preselected geometric patterns. Emitters within an area of the emitter array can be operated in unison to provide uniform emission of electrons over the area. The field-emitting arrays can be used in devices such as high power microwave devices which benefit from having such electron sources.

PRIOR ART

Individual field emitters and arrays of field emitters are made by different methods. Each method has advantages and disadvantages.

Individual emitters are generally formed from fine metallic wires having a pointed tip which has a radius of curvature of approximately 10 nm. Although such emitters made of tungsten are relatively durable, they must be carefully protected from mechanical damage. Also, it is awkward to change such emitters because they must be carefully positioned with respect to a separately mounted extractor. Such individual emitters cannot be easily arranged into arrays containing many individual tips.

There are two principal methods for producing closely spaced arrays of field emitters. One method is to fabricate the array by microelectronic techniques. The other method is to fabricate the array from sections cut from metal/oxide composite rods which are produced by the directional solidification of eutectic composition melts.

One microelectronic approach consists of etching holes on the surface of a silicon wafer and vapor depositing a metal through the holes in such a way as to produce a pyramidal mound centered in them. The peak of each mound functions as a field emitter. Attractive features of such emitter arrays are that they can be fabricated with regular spacings, the emitters can be made to operate individually, and the extractor can be formed on the surface of the wafer thus eliminating positioning problems. However, because the resistively generated heat must be conducted through the emitter to a heat sink, the arrays must be operated at relatively low current levels or the tips will overheat.

Arrays can also be fabricated from disc cut from directionally solidified metal/oxide eutectic rods. The discs are cut so that fine, rod-shaped metal fibers are normal to the cuts. The cut surfaces are etched to remove oxide from around the fiber ends and to form sharp tips on the fibers. Extractors (anodes) can be formed on the cut surface. These emitting arrays suffer the same current limitations as those fabricated by microelectronic techniques. Also, the spacing and configuration of emitters within the arrays is determined by the conditions when the eutectic rods solidify. There is only a slight control over the size of the fibers and no control over their geometry.

It is, therefore, an object of the invention to provide field-emitting arrays which can be operated at high current levels and which can be readily fabricated with individual electron emitters of preselected diameters, spaced at preselected distances from one another, in preselected geometries.

SUMMARY OF THE INVENTION

These and other objects are provided in one embodiment of the invention by a field-emitting array which comprises an electrically insulating wafer of glass, pyroceramic, or fine-grained poly-crystalline oxide. The wafer has electrically conducting filaments extending between two surfaces of the wafer and extending beyond the plane of one surface. The end of the filaments extending beyond the wafer surface are shaped to emit electrons when an electrical field is applied between the filaments and an anode. The cylindrical surfaces of filaments extending beyond the first surface of the wafer can have an electron-emitting coating that extends beyond the end of the filament. The filaments extending from the first surface of the wafer can be electrically isolated from one another.

In another embodiment of the invention, a field-emitting array is provided, wherein one end of the filament is recessed, insulating material is removed from around the exposed end so that the filaments ends are selectively spaced from the insulating matrix, and the first surface is coated with an electrically conducting film that acts as an electron extractor.

BRIEF DESCRIPTION OF THE DRAWINGS

These and various other objects, features, and advantages of the present invention will be more fully appreciated as they become better understood when considered in conjunction with the accompanying drawings, in which like reference characters designate the same or similar parts throughout the several views, and wherein:

FIG. 4(*b*) illustrates the alternate end treatment applied to the embodiments of FIGS. 1 and 2; FIG. 4(*c*) illustrates the alternate end treatment applied to the embodiment of FIG. 3.

FIGS. 5 through 8 illustrate the method of fabricating the field emitting arrays of this invention wherein:

FIG. 5 is an illustration of the first stage of fabricating the field emitting arrays of this invention;

FIG. 6 is an illustration of an intermediate stage of processing the field emitting arrays of this invention;

FIG. 7 shows the wafer of FIG. 1 after a top section of the metal filaments have been removed and an electrically conductive coating has been applied to the bottom surface of the wafer;

FIG. 8 shows the wafer of FIG. 7 after the top surface of the wafer has been etched to selectively space the ends of the filaments from the glass matrix.

DETAILED DESCRIPTION

Figure 1:
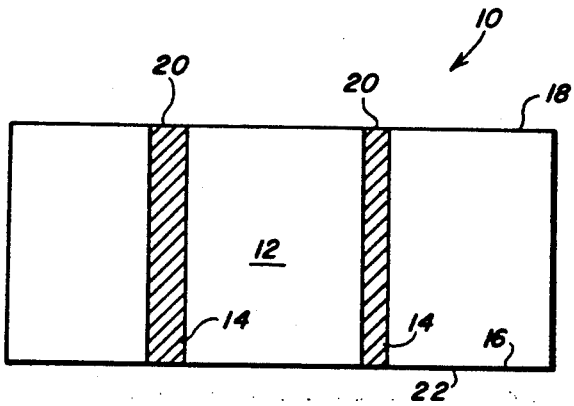
FIG. 1 is a partial, enlarged cross-sectional view of a field emitting array according to the invention.

Referring now to the drawings, wherein like numerals denote like or similar elements, and in particular to FIG. 1 which shows one embodiment of the invention. Wafer 10 has an amorphous glass matrix 12 through which conducting filaments 14 extend between surfaces 16 and 18. Filament ends 20 lie in the plane of surface 18. When a voltage applied to filaments 14 makes the filaments sufficiently negative with respect to an anode (not shown), the filaments will emit electrons.

Preferably, filaments 14 are formed of germanium, silicon, gallium arsenide, copper, gold, silver, platinum, palladium, rhodium, iron, or nickel, or alloys thereof. Preferably, these filaments have a diameter of less than about 10 μm; and, more preferably, the filament diameter ranges from about 0.01 to 10 μm.

The processing of wafer 10 should ensure that the ends of filaments 14 retain relatively sharp, nearly square, shoulders. There will be an effective radius of curvature along the circumference between filament end 20 and the cylindrical surface of filament 14. Filament 14 will be shaped to emit electrons if the effective radius of curvature is sufficiently small that the circumference of end 20 will emit electrons. Because the circumference will be the electron emission source, the electron emission is distributed rather than concentrated at a single point.

Surface 16 may be coated with conductive layer 22—such as by vapor deposition or sputtering—so as to form a conductive connection between the exposed ends of filaments 14. Suitable coating metals include gold, silver, platinum, rubidium, and copper. The coated face of wafer 10 can then be joined to a conductive substrate (not shown); for example, coated surface 16 could be soldered to a copper plate. Preferably, the conductive substrate will have a thermal coefficient of expansion corresponding closely to that of glass matrix 12.

Conductive layer 22 could be masked to electrically isolate areas containing multiple filaments 14. Addressable connections could then be made by area rather than by individual emitter. This area addressability would be advantageous in displays because filaments 14 are small enough that a large number of emitters could be contained in an area too small to be resolved by normal vision.

Practical considerations limit the thickness of wafer 10. If wafer 10 is too thick, it is more difficult to conduct the electrical resistance heat out of the filament; also, with plural filament embodiments, there is an increased likelihood of developing breaks in filaments 14. If wafer 10 is too thin, residual stresses make the wafer difficult to handle. Preferably, wafer 10 is from about 0.1 to 1.0 mm in thickness.

Figure 2:
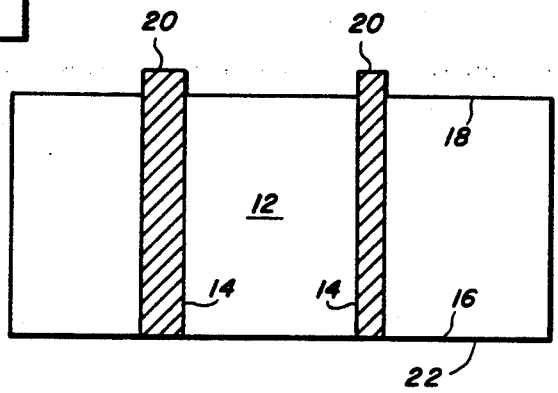
FIG. 2 is a partial, enlarged cross-sectional view of an alternate embodiment of the invention.

An alternate embodiment of the field emitter array is shown in FIG. 2. Here, filaments 14 extend beyond surface 18 to reduce the interaction between the emitted electrons and insulating matrix 12.

Figure 3:
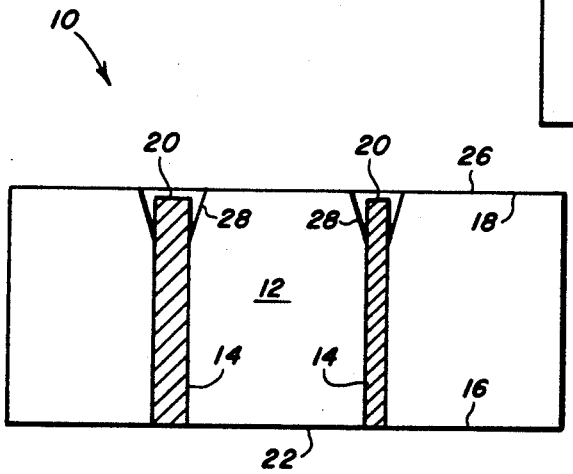
FIG. 3 is an enlarged sectional view of another embodiment of the invention.

Another alternate embodiment of the field emitter array is shown in FIG. 3. Here, filaments 14 are recessed below surface 18 which is covered by conducting layer 26. Associated with each filament end 20, there is a hole 28 in surface 18 and layer 26. Hole 28 in surface 18 is sized to improve the performance of field emitting array 10. Layer 26 thus forms a self-positioned extractor grid for emitting filaments 14.

Wafer 10 is an emitter array with conducting coating 26 on surface 18, where ends 20 of filaments 14 are recessed from surface 18, and where glass matrix 12 is etched away slightly to expose a portion of walls 28 of filaments 14. Glass matrix 12 protects filament ends 20, now emitters, from mechanical damage. The extraction grid formed by coating 26 can pull electrons from the perimeter of filaments 14 when a relatively low voltage electrical potential is established.

In the embodiments of FIGS. 2 and 3, is in the embodiment of FIG. 1, the primary electron emission source is the circumference of filament end 20. However, in the embodiment of FIG. 3 the anode (the extraction grid formed by layer 26) is close enough to allow filament 14 to emit electrons at a much lower voltage than would be required for the embodiments of FIGS. 1 or 2.

Figure 4A:
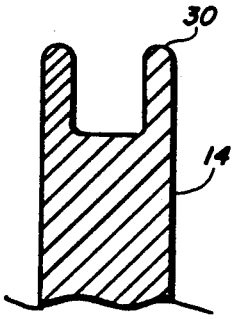
FIG. 4(*a*) is an enlarged cross-sectional view of an alternate end for the emitting filaments.
Figure 4B:
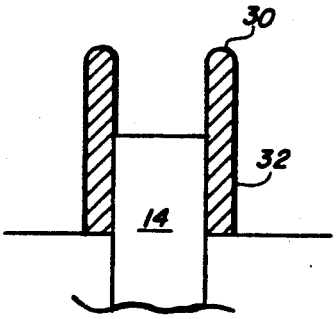
Figure 4C:
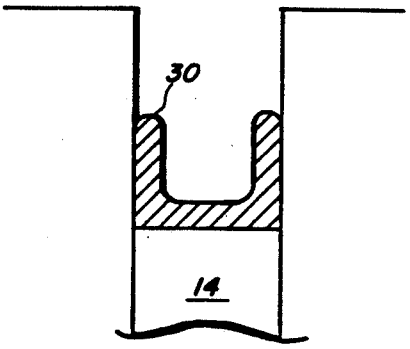

An improved treatment for filament ends 20 is shown in FIG. 4(*a*). Filament 14 has an annular ring 30 extending beyond the end of filament end 20. The exposed edge of ring 30 is the primary source of electron emission. The wall of ring 30 is thin enough that the exposed edge has an effective radius of curvature small enough to efficiently emit electrons. Thus, ring 30 assures that filament 14 is shaped to emit electrons. Because ring 30 can be added after the wafer is cut and polished, the ring avoids the mechanical damage that can deform the circumference of end 20 into a radius too large to emit. Thus, filaments 14 with ring 30 will emit more uniformly than filaments without the ring.

Preferably, ring 30 is about 5–500 nm thick, and more preferably 10–100 nm thick. Preferably ring 30 extends about 5–500 nm beyond the end of filament 14, and more preferably, about 10–100 nm beyond the end.

The annular ring of FIG. 4(*a*) can be applied to the field emitting arrays of FIGS. 2 and 3. FIGS. 4(*b*) shows the annular ring 30 applied to the extending filament embodiment of FIG. 2. Conducting layer 32 coats the cylindrical surface of that part of filament 14 that extends past surface 18. FIG. 4(*c*) shows annular ring 30 applied to the recessed filament embodiment of FIG. 3. Ring 30 forms a cup attached to filament end 20

Advantageously, ring 30 can be made of a conducting material that has a low work function, that is, it emits electrons easily. Suitable coating materials include, for example, platinum, rhodium, iridium, osmium, rubidium, tungsten, tantalum, tantalum carbide, titanium carbide, titanium nitrite, zirconium carbide, zirconium nitrite, and lanthanum hexaboride.

Figure 5:
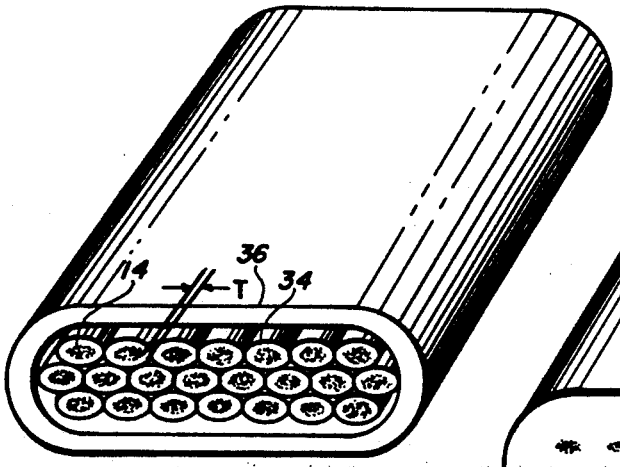
Figure 6:
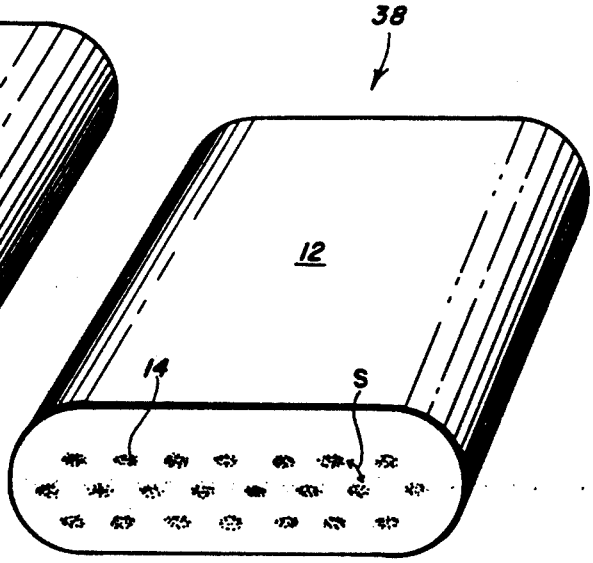

The method of fabricating the embodiment of FIG. 1 is illustrated by FIGS. 5 and 6. FIG. 5 shows fibers 34 inserted into glass preform 36. Each glass fiber 34 could have either a single filament 14 or a plurality of filaments 14 extending therethrough. Each fiber 34 has glass of thickness T covering the individual filament 14 or covering the group formed by plural filaments 14.

Fibers 34 and preform 36 are heated under vacuum to remove residual gases and water vapor; preform 36 is sealed while under vacuum. Sealed preform 36 is then heated to the glass softening temperature and hot isostatically pressed at a pressure sufficient to cause the glass to collapse and form a solid, pore-free consolidate 38, as shown in FIG. 6. Resulting consolidate 38 has metal filaments 14 surrounded by continuous glass matrix 12. By selecting the forms in which the consolidate is pressed, the consolidate (and thus the wafers cut from it) can have a preselected geometry.

There is a preselected spacing S between filaments 14 or between the groups formed by plural filaments 14 that were originally within individual fibers 34. This preselected spacing S is established by thickness T of the glass in each fiber 34 in cluster 10. Control of the filament diameter and spacing gives control over the volume fraction and density of the filaments. Additionally, the geometry of filaments 14 within consolidate 38 can be preselected by controllably placing blank fibers (fibers without filament 14) into preform 36. No filament 14 will occur in the position occupied by the blank fiber; however, spacing S of the remaining filaments 14 will not be altered.

The materials used for fibers 34 and metal filaments 14 must be chosen together to ensure that the melting point of the metal is compatible with the working temperature of the glass. Because copper has high electric and thermal conductance (that is, copper generates little electrical resistance heat and it easily conducts away that heat), copper is a good choice for filament 14. Because borosilicate and aluminosilicate glasses have working temperature ranges that are compatible with the melting point of copper, they work well as glass matrix 12 when copper is chosen for filament 14.

For fibers with borosilicate or aluminosilicate glasses, sealed glass preform 36 is preferably heated to a temperature of from about 700°–825° C. and pressed at a pressure from 100 to 30,000 psi; and, more preferably, a pressure from about 1000 to 10,000 psi.

The time of the hot pressing cycle can be limited to control crystallization of glass matrix 12 and limit the diffusive breakdown of metal filaments 14. For example, consider Kimbell KG-33 glass fibers with germanium filaments produced as described in copending U.S. Application No. 07/560,703. If these fibers are hot isostatioally pressed at 825° C. at a pressure of from 8000–10,000 psi for a period of from about 10–20 minutes, then: the filaments will remain continuous, the resultant matrix structure will be substantially free of crystallization, and the germanium filaments will retain their thin cylindrical shape.

However, the time of the hot pressing cycle can be extended to allow the amorphous glass to partially crystalize and form a pyro-ceramic. Alternately, the hot press time can be extended until the glass fully crystallizes into a fine-grained poly-crystalline oxide Wafers of glass, pyro-ceramic, and fine-grained poly-crystalline oxide are all useable in this invention.

The embodiment of FIG. 4(*b*) can be fabricated from the embodiment of FIG. 1. Surface 18 is etched to remove a portion of glass matrix 12 so that metal filaments 14 extend a distance of from about 0.1–5 μm from etched surface 18. The exposed cylindrical surfaces of filaments 14 are then coated with a layer of conducting material 32 which has good thermal and chemical stability. If directional techniques, such as vapor deposition, are used to coat the lateral surfaces of filaments 14, it may be necessary to incline the axis of filaments 14 relative to the directional source and to rotate wafer 10. However, no special precautions are required if non-directional techniques, such as electro-deposition, are used to coat filaments 14. Conductive coating 32 may have been deposited on surface 18 of glass matrix 12 and on the end of filaments 14. Coating 32 can be removed from these areas by sputtering or by other suitably directional techniques. If excess coating material is to be removed by a process that could attack the sidewall of the filament 14, it is important that substantially all of the cylindrical surfaces, or sidewalls, of exposed filaments 14 are coated. In general, the thickness of sidewall coating 32 is limited in that the electron-emitting radius of curvature of the outer edge of ring 30 should be no more than 30 nm. Preferably, the coating on the sidewalls is at least several atoms thick but not more than a few hundred atoms thick.

Finally, a small length of filament 14 is selectively etched away so as to leave a short ring 30 of coating 32 extending beyond the end of filament 14.

Figure 7:
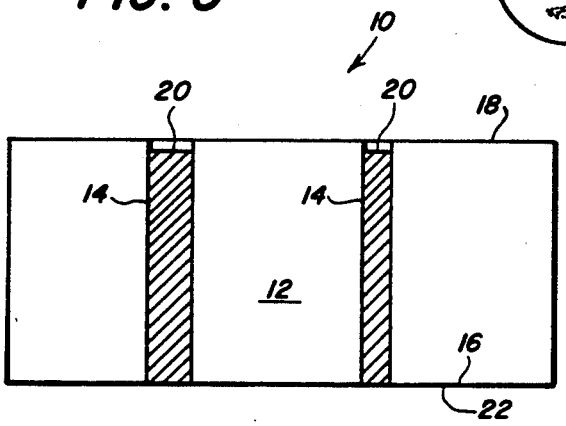
Figure 8:
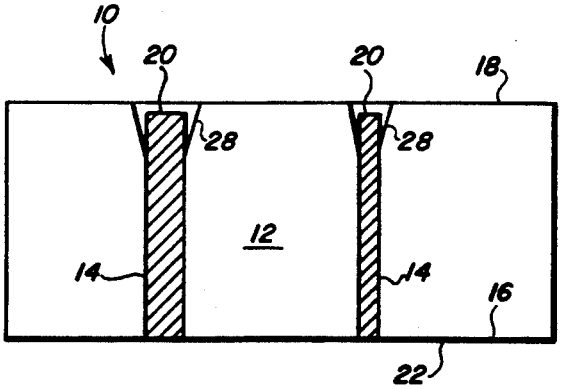
Figure 9:
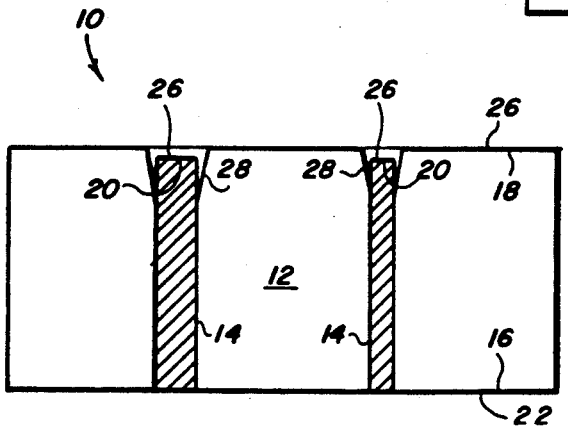
FIG. 9 shows the wafer of FIG. 8 after a coating has been directionally applied to the top surface and the ends of the recessed filaments.

The alternative embodiment of FIG. 3 is obtained when the embodiment of FIG. 1 is further processed as shown in FIGS. 7–9. The resulting embodiment has a field-emitting array with a self-positioned electron extracting grid.

FIG. 7 shows wafer 10 after surface 18 is subjected to ion milling or chemical dissolution to remove from about 0.5 to 10 μm from end 20 of filaments 14. As a result, filaments 14 are recessed below surface 18.

FIG. 8 shows wafer 10 of FIG. 7 after glass matrix 12 is etched. Etching removes a small portion of glass matrix I2, thus forming holes with glass walls 28 adjacent to end 20 of filament 14. Etching controllably enlarges the hole through which filament ends 20 are exposed. Preferably, wafer 10 is etched to remove about 0.1 to 1 μm of glass matrix 12 to a depth of 0.1 to 10 μm below end 20 of filament 14.

FIG. 9 shows wafer 10 of FIG. 8 after surface 18 of wafer 10 is coated with an electrically conducting material such as Au, Mo, or W. A directional coating process, such as ion plating, is used to deposit coating 26 on surface 18 without coating wall 28. Coating 26 forms an extraction grid closely situated to ends 20 of filaments 14. Electrically conducting coating 26 may cover filament ends 20. Coating 26 can be removed from filament ends 20 by electrochemical dissolution achieved by making anodic connection through electrical coating 22. FIG. 3 shows the resulting embodiment.

All these embodiments are readily adaptable to devices where the whole area is uniformly driven to achieve high current, such as in microwave drivers. Alternately, any embodiment could be used in devices requiring addressability, such as displays. While connection to individual fibers may be difficult, the device could be masked and addressed by areas containing multiple emitters. Each area could then drive a single dot on the display.

From the foregoing descriptions, one skilled in the art can ascertain the essential characteristics of this invention and, without departing from the spirit and scope thereof, can make various changes and modifications of the invention to adapt it to various usages and conditions.

What is claimed is:

1. A field-emitting array comprising:

an insulating wafer of a material selected from the group consisting of glass, pyro-ceramic, and fine-grained polycrystalline oxide, and wherein said wafer is less than about 1.0 mm thick and has two substantially parallel surfaces;

electrically conducting filaments extending between said substantially parallel surfaces, wherein the diameter of said filaments is less than about 10 μm, and wherein said filaments are made of a material selected from the group consisting of germanium, gallium arsenide, silicon, copper, gold, silver, platinum, palladium, iron, nickel and alloys thereof, said filaments extending beyond one of said substantially parallel surfaces; and an electron-emitting coating on the surfaces of said filaments that extends beyond said surface of said wafer, wherein said electron-emitting coating extends beyond the end of said extending filaments, and wherein said electron-emitting coating is made of a material selected from the group consisting of platinum, rhodium, iridium, osmium, rubidium, tungsten, tantalum, tantalum carbide, titanium carbide, titanium nitrate, zirconium carbide, zirconium nitride, and lanthanum hexaboride.

2. The field-emitting array comprising:

an electrically insulating wafer formed of a material selected from the group consisting of an amorphous material, a fine grained, poly-crystalline material, and a mixture thereof, said wafer having substantially parallel surfaces;

electrically conducting filaments extending between said parallel surfaces through said wafer and beyond one said parallel surface of said wafer, at one surface of said wafer said filaments having a shape to emit electrons;

wherein said shape to emit electrons comprises an electron emitting annular ring at that end of said conducting filaments that extends beyond said surface.

3. The field-emitting array of claim 2, wherein said electron-emitting annular ring has a coating thereon made from a material selected from the group consisting of platinum, rhodium, iridium, osmium, rubidium, tungsten, tantalum, tantalum carbide, titanium carbide, titanium nitrite, zirconium carbide, zirconium nitrite, and lanthanum hexaboride.

4. The field-emitting array of claim 2, wherein said filaments extending from said surface of said wafer are electrically isolated from one another at that surface.

5. A field-emitting array comprising:

an electrically insulating wafer formed of a material selected from the group consisting of an amorphous material, a fine grained, poly-crystalline material, and a mixture thereof, said wafer having multiple surfaces;

electrically conducting filaments extending through said wafer having said multiple surfaces, at one surface of said wafer said filaments being shaped to emit electrons, said filaments being recessed below said surface of said wafer;

an electron extraction grid formed by a conducting coating on said surface below which filaments are recessed, said grid having an opening associated with each said recessed filament; and an electron-emitting annular ring on the recessed end of the conducting filaments that extends beyond said surface.

6. The field-emitting array of claim 5, wherein said electron-emitting annular ring has a coating thereon made from a material selected from the group consisting of platinum, rhodium, iridium, osmium, rubidium, tungsten, tantalum, tantalum carbide, titanium carbide, titanium nitrite, zirconium carbide, zirconium nitride, and lanthanum hexaboride.

7. The field-emitting array of claim 5, wherein said electron-emitting annular ring has a coating thereon made from a material selected from the group consisting of platinum, rhodium, iridium, osmium, rubidium, tungsten, tantalum, tantalum carbide, titanium carbide, titanium nitrite, zirconium nitride, and lanthanum hexaboride.

8. A field-emitting array comprising:

an electrically insulating wafer having multiple surfaces;

electrically conducting filaments through and perpendicular to one surface of said wafer, said filaments extending beyond said surface;

an electron coating on said filaments, said coating forming an electron-emitting annular ring on said conducting filaments that extends beyond said surface.

* * * * *